US007819039B2

(12) United States Patent
Kim

(10) Patent No.: US 7,819,039 B2
(45) Date of Patent: Oct. 26, 2010

(54) STEERING APPARATUS

(76) Inventor: Young Choong Kim, 18-701 21/8 Asia Athlete village Apt, Jamsil- dong 86, Songpa-gu, Seoul (KR)

( * ) Notice: Subject to any disclaimer, the term of this patent is extended or adjusted under 35 U.S.C. 154(b) by 0 days.

(21) Appl. No.: 12/473,518

(22) Filed: May 28, 2009

(65) Prior Publication Data

US 2009/0293791 A1 Dec. 3, 2009

(30) Foreign Application Priority Data

May 29, 2008 (KR) ..... 10-2008-0050221

(51) Int. Cl.
*B62D 1/04* (2006.01)

(52) U.S. Cl. ..... 74/552; 114/154

(58) Field of Classification Search ..... 114/154; 74/552

See application file for complete search history.

(56) References Cited

U.S. PATENT DOCUMENTS 4,273,209 A * 6/1981 Orain ..... 180/254
5,413,535 A * 5/1995 Reik ..... 474/94
5,419,585 A * 5/1995 Breed et al. ..... 280/731
6,250,334 B1 * 6/2001 Abraham et al. ..... 137/625.23
2002/0023517 A1 * 2/2002 Ochiai et al. ..... 74/552
2008/0236328 A1 * 10/2008 Ai et al. ..... 74/552

* cited by examiner

*Primary Examiner*—Stephen Avila
(74) *Attorney, Agent, or Firm*—Lowe Hauptman Ham & Berner LLP

(57) ABSTRACT

Disclosed herein is a steering apparatus of a small ship such as a motorboat, which prevents abrasion and noise caused by a gap between a rotary cover and a rotary plate and maximizes steering handle rotation prevention effect. The steering apparatus includes a cylindrical fixed frame; the rotary plate rotatably set inside the fixed frame; a plurality of mounts arranged on the rotary plate and having rolling elements and elastic elements mounted thereon; the elastic elements mounted on the mounts and applying elasticity to the rolling elements to press the rolling elements against the inner face of the fixed frame; the rotary cover including a movable part having movable pieces capable of pressing the rolling elements when a steering shaft is operated and covering the top of the rotary plate to prevent the rolling elements and the elastic elements from being separated from the mounts; the steering shaft penetrating the fixed frame, the rotary plate and the rotary cover; and elastic pads respectively attached to portions of the movable pieces, which come into contact with the rolling elements, to eliminate a gap between each movable piece and each rolling element.

8 Claims, 17 Drawing Sheets

STEERING APPARATUS

BACKGROUND OF THE INVENTION

1. Field of the Invention

The present invention relates to a steering apparatus of a small ship such as a motorboat, and more particularly, to a steering apparatus for eliminating a gap between a rotary cover and a rotary plate of the steering apparatus to prevent abrasion and noise from being generated caused by the gap to thereby maximize steering handle rotation prevention effect.

2. Background of the Related Art

Generally, a small ship includes a steering handle H which is rotatable and provided in front of a cabin and an engine E which is horizontally rotatable and attached to the stern, as illustrated in FIGS. 1 and 2.

The handle H is connected to the engine E via a steering module 100 and a cable C, and thus the cable C is pulled or released through the steering module 100 when a driver operates the handle H to rotate the engine E to the left or right so as to change the direction of the ship.

A handle steering apparatus includes a top case 200, a bottom case 300, the steering power transmission module 100, a steering shaft 400, a reduction gear unit 500 and a torque module 700.

The steering power transmission module 100 includes a rotating plate 110, which is set inside the top case 200 and the bottom case 300 and rotated by the rotary power of the steering handle H, and the cable C winding round the outer rim of the rotating plate 110.

The top case 200 has a penetration hole 210 formed at the center thereof, four insertion grooves 230 formed at the inner side thereof, and two cable guide grooves 250 through which the cable C connected to the rotating plate 110 passes. The two cable guide grooves 250 are formed at one side of the top case 200 and opened to the outside of the top case 200. The steering shaft 400 penetrates the penetration hole 210.

The bottom case 300 includes an internal gear 310 formed at the inner side thereof and a shaft hole 330 formed at the center thereof. The steering shaft 400 penetrates the shaft hole 330.

The reduction gear unit 500 is set in the bottom case 300 in contact with the internal gear 310. The reduction gear unit 500 includes a shaft gear 500 and three gears 510 for reducing the speed of revolution of the handle H and transmitting the reduced speed to the rotating plate 110. The three gears 510 are arranged around the shaft gear 500 and engaged with the shaft gear 500.

The steering shaft 400 includes a screw thread 410 formed at one end thereof, penetrates the top case 200 and the bottom case 300 and is combined with the handle H by using the screw thread 410. The other end of the steering shaft 400 is inserted into the shaft hole 330 of the bottom case 300.

The torque module 700, which controls the operating power of the steering shaft 400, is attached to the steering shaft 400 rotated by the operating power of the handle H. The torque module 700 is disclosed in Korean Patent No. 10-0748428 previously applied by the Applicant.

Specifically, the torque module 700 includes a cylindrical fixed frame 710 fixed to the top case 200, a rotary plate 720 rotatably set in the fixed frame 710, a plurality of mounts 721 which are arranged on the rotary plate 710 such that rolling elements 730 and elastic elements 740 are mounted thereon, and a rotary cover 760 which includes a movable part having movable pieces 761 capable of pressing the rolling elements 730 when the steering shaft 400 is operated and covers the top of the rotary plate 720 to prevent the rolling elements 730 and the elastic elements 749 from being separated from the torque module 700.

The steering shaft 400 penetrates the fixed frame 710, the rotary plate 720 and the rotary cover 760. The fixed frame 710 includes a plurality of protrusions 711 formed on the outer face thereof. The protrusions 711 of the fixed frame 7100 are inserted into the four insertion grooves 230 of the top case 200 to prevent the steering apparatus from rotating.

The movable pieces 761 of the rotary cover 760 are tapered in such a manner that the ends of the movable pieces 761 are thinner, and thus the rotary cover 760 can be easily removed from a mold when the rotary cover 760 is manufactured.

In the conventional steering apparatus described as above, when the handle H is rotated to one direction while the ship is running, the operating power of the steering shaft 400 is transmitted to the rotating plate 110 through the reduction gear unit 500 to rotate the rotating plate 110 to the left or right. The cable C is pulled or released according to the revolution of the rotating plate 110 to move the engine E to the left or right so as to adjust the moving direction of the ship.

The operation of adjusting the moving direction of the ship and a function of preventing the steering handle H from rotating when a driver does not grip the steering handle H will now be explained in detail with reference to FIGS. 3 through 8.

When the steering handle H is rotated to the left or right (clockwise or counter clockwise) according to the rotating power of the steering shaft 400 while the ship is running, the movable piece 761 presses the rolling elements 730 located in the rotating direction of the handle H, and thus the rolling elements 730 are separated from the inner face of the fixed frame 710 according to compression of the elastic elements 740 (refer to "A" of FIG. 5 and "B" of FIG. 7).

Rolling elements 730 which are not pressed by the movable piece 761 are movable although they are pressed against the inner face of the fixed frame 710 according to the restoring force of the elastic elements 740.

That is, when the handle H is rotated to the left or right (clockwise or counter clockwise) according to the operating power of the steering shaft 400, the rotary cover 760 is rotated and the rolling elements 730 located in the rotating direction are separated from the inner face of the fixed frame 710 according to compression of the elastic elements 740 to rotate the rotary plate 720. Accordingly, the operating power is transmitted to the cable C through the reduction gear unit 500 to adjust the direction of the ship.

When the operating power is eliminated, the rolling elements 730 mounted on the mounts 721 are pressed against the inner face of the fixed frame 710 and function as a wedge to fix the rotary plate 720, as illustrated in FIGS. 3 and 4, and thus the steering shaft 400 is fixed and the direction of the ship is also fixed.

However, the conventional steering apparatus has the following problem.

A gap t between the rotary plate 720 and the rotary cover 760 affects the operation of the handle H.

That is, when the cable C vibrates according to vibration of the engine E, the movable pieces 761 are affected by the cable C, and thus the handle H idles within the gap t between the movable pieces 761 and the rolling elements 730 to generate noise and abrasion at the movable pieces 761 and interfered portions of the movable pieces due to the gap t.

When the driver steers the steering handle H to the left or right, the steering handle H is moved to the left or right and the cable C is also moved to the left or right. Even when the engine E vibrates while the steering handle H is stopped by the operation of the steering apparatus to apply a force in the range of 700 to 800 kg to the cable C, the steering handle H is not moved.

As described above, the conventional steering apparatus generates noise and abrasion due to the gap between the rotary plate 720 and the rotary cover 760. The gap makes the steering handle H drag when the driver initially operates the steering handle H because the movable pieces 761 of the rotary cover 760, which are made of metal, and the rotary plate 720 come into contact with each other.

Furthermore, since the movable pieces 761 of the rotary plate 760, which press the rolling elements 730, are tapered in order to easily separate the rotary plate 760 from the mold when the rotary plate 760 is manufactured, the movable pieces 761 partially come into contact with the rolling elements 730 (refer to FIG. 6).

Accordingly, partial load is applied to the rolling elements 730, and thus reliability of the operation of the torque module 700 may be deteriorated and components being in contact with each other may be partially abraded.

SUMMARY OF THE INVENTION

Accordingly, the present invention has been made in view of the above-mentioned problems occurring in the prior art, and it is a primary object of the present invention to provide a steering apparatus for eliminating a gap between a rotary cover and a rotary plate to prevent noise and abrasion caused by the gap and maximize steering handle rotation prevention effect.

To accomplish the above object of the present invention, according to the present invention, there is provided a steering apparatus including a cylindrical fixed frame; a rotary plate rotatably set inside the fixed frame; a plurality of mounts arranged on the rotary plate such that cylindrical rolling elements and elastic elements are mounted thereon; a rotary cover having a movable part with movable pieces capable of pressing the rolling elements when a steering shaft is operated and covering the top of the rotary plate to prevent the rolling elements and the elastic elements from being separated from the mounts; the elastic elements mounted on the mounts to apply elasticity to the rolling elements to press the rolling elements against the inner face of the fixed frame; and the steering shaft penetrating the fixed frame, the rotary plate and the rotary cover, wherein the movable pieces press the rolling elements according to the operating power of the steering shaft such that the rolling elements are separated from the inner face of the fixed frame to rotate the rotary plate and, when the operating power of the steering shaft is cancelled, the rolling elements are pressed against the inner side of the fixed frame according to the restoring force of the elastic elements to fix the steering shaft. The steering apparatus includes elastic pads which are attached to portions of the movable pieces, which come into contact with the rolling elements 730, and capable of eliminating the gap between the movable pieces and the rolling elements.

The steering apparatus according to the present invention has the following advantages.

The gap between the rolling elements and the movable piece is eliminated by the elastic pads. Accordingly, the movable pieces are not moved when the operating power of the steering shaft is cancelled while the ship is running because the gap is eliminated by the elastic pads. Therefore, the steering handle is not moved even if the cable is pulled or released according to vibration of the engine, and thus the handle rotation prevention effect can be securely achieved.

Furthermore, tilted faces of the movable pieces are compensated by the elastic pads, and thus direct contact of the rolling elements and the movable pieces is prevented so as to restrain generation of partial abrasion of the rolling elements and the movable pieces.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
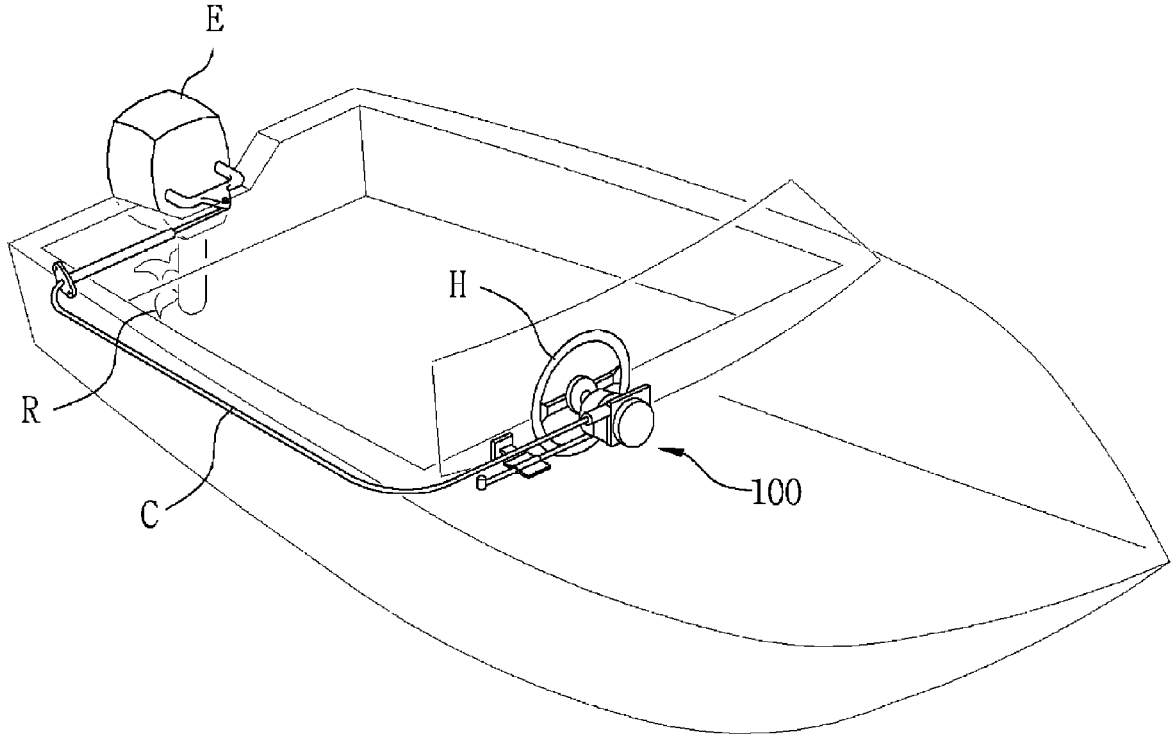
FIG. 1 is a perspective view of a conventional boat.
Figure 2:
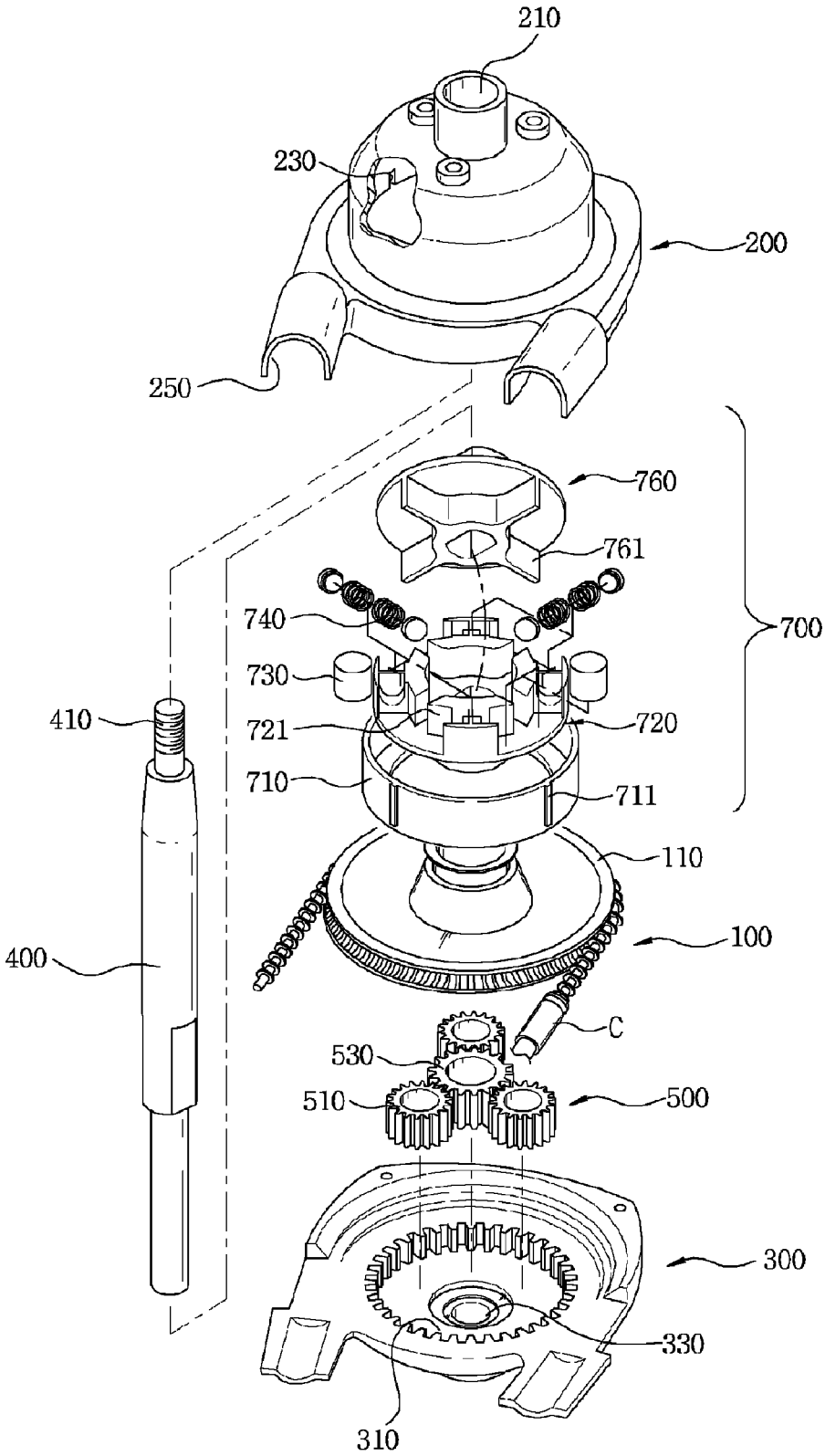
FIG. 2 is an exploded perspective view of a conventional steering apparatus.
Figure 3:
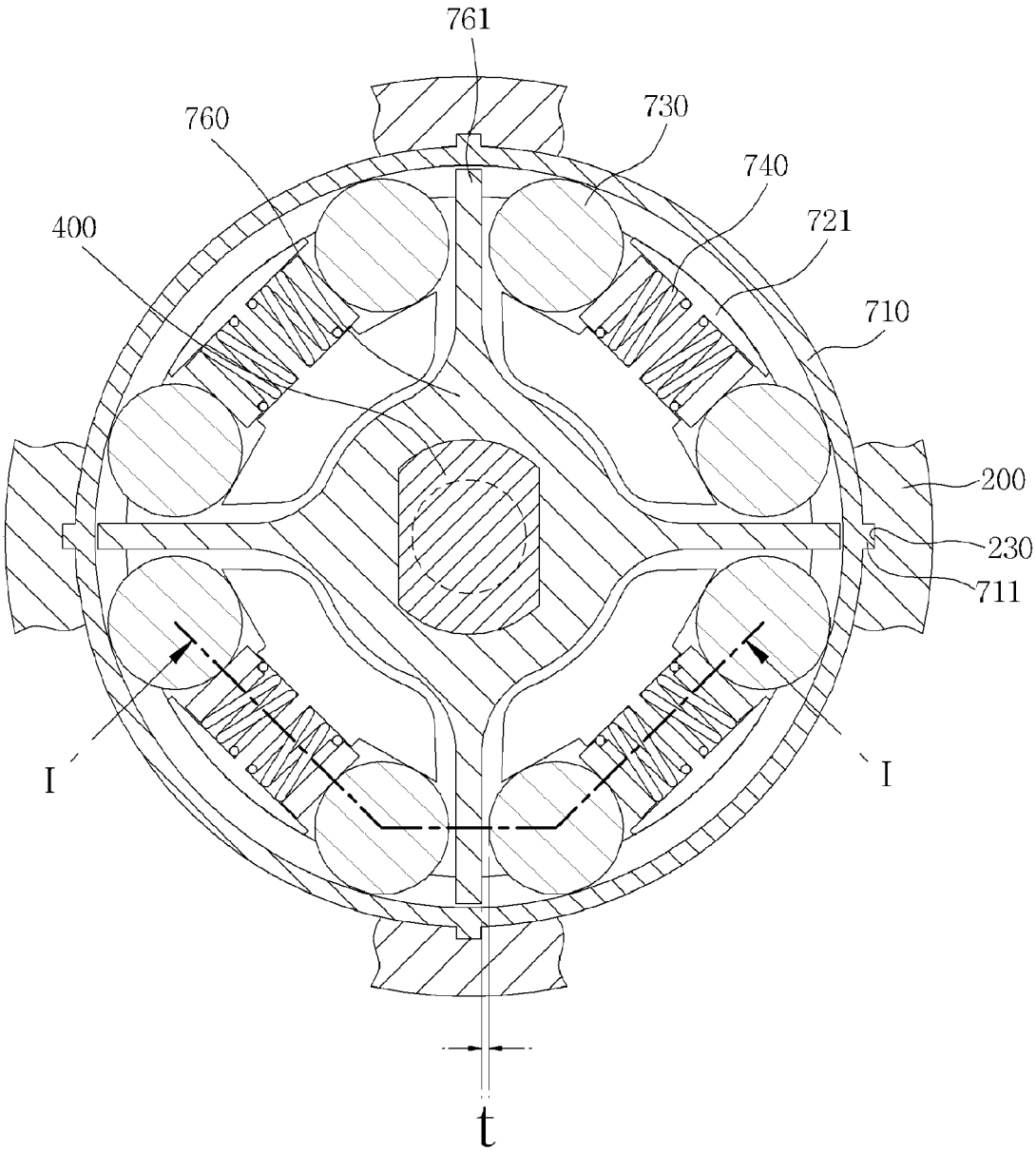
FIG. 3 illustrates a state that a movable piece located between neighboring mounts is not moved.
Figure 4:
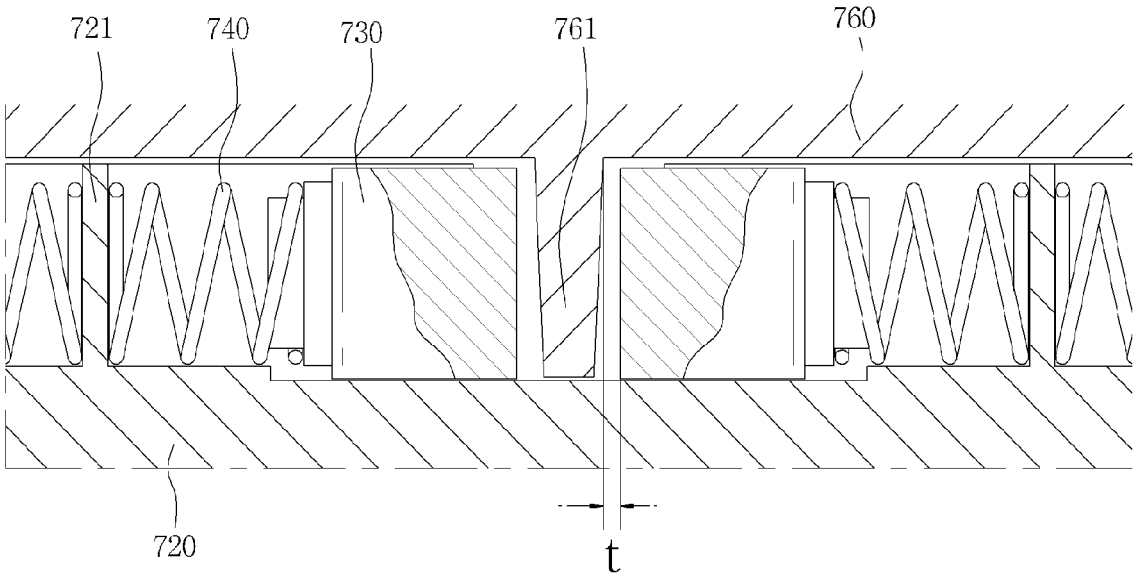
FIG. 4 is a cross-sectional view taken along line I-I of FIG. 3.
Figure 5:
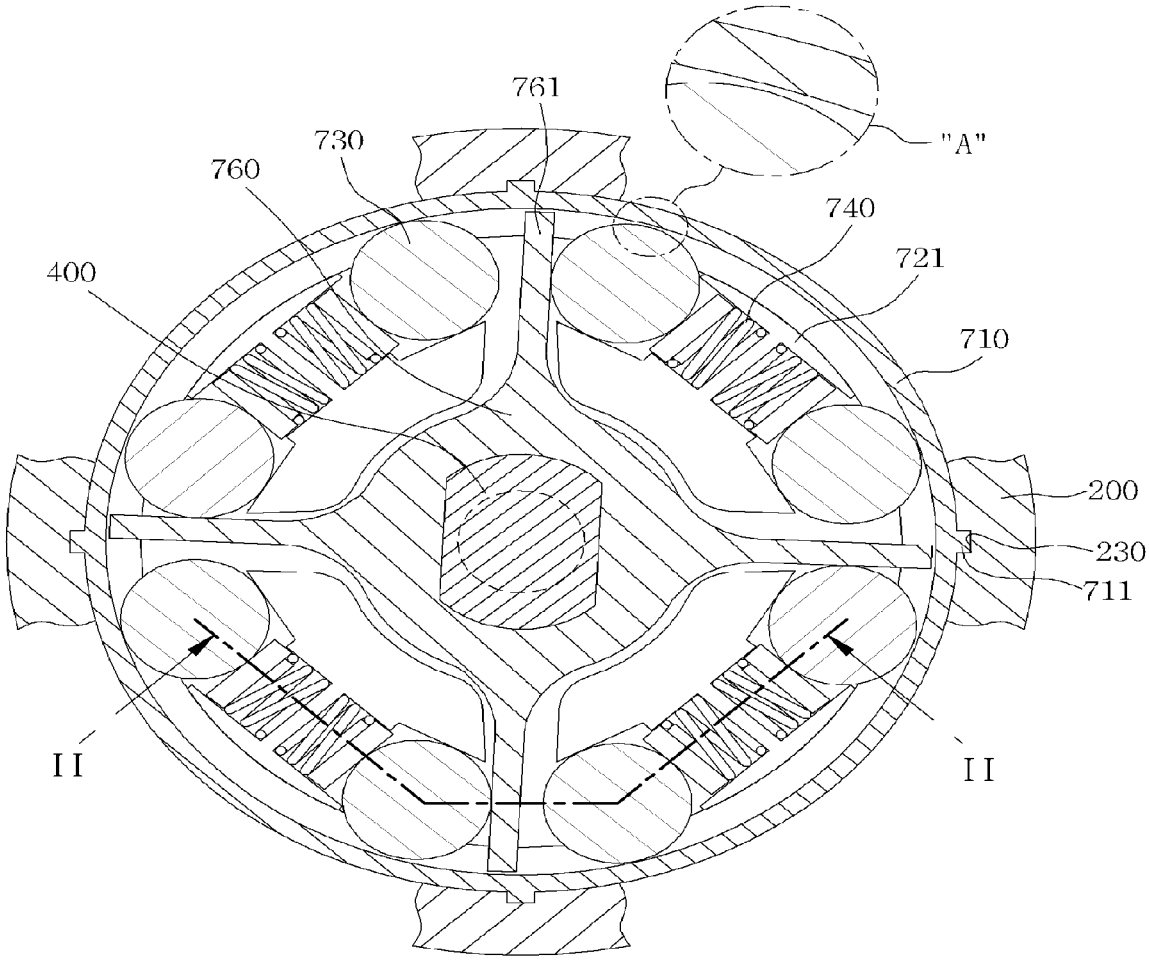
FIG. 5 illustrates a state that the movable piece located between neighboring mounts is moved to the left.
Figure 6:
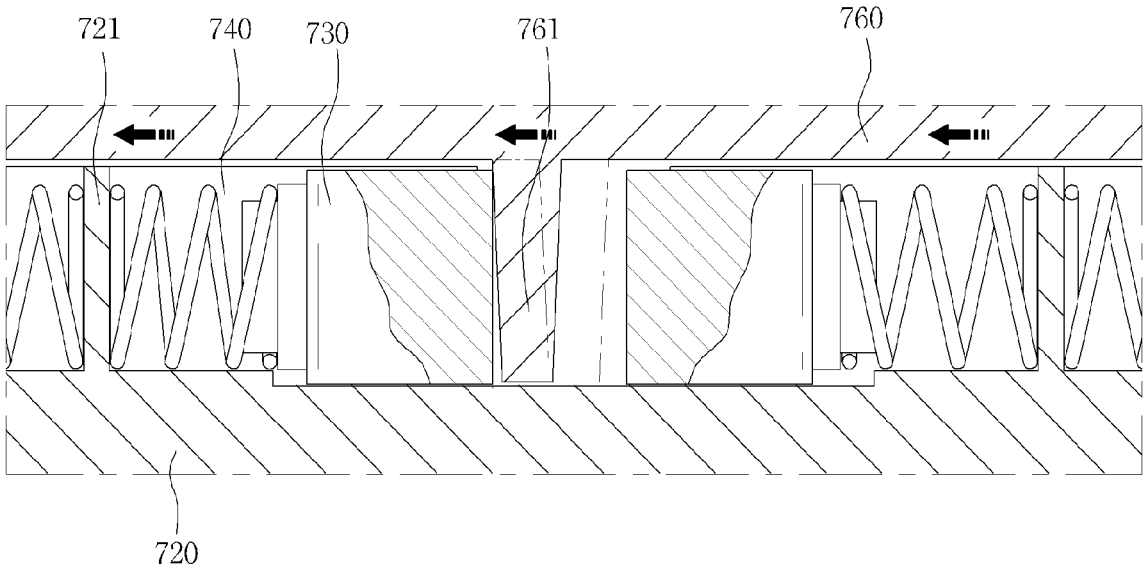
FIG. 6 is a cross-sectional view taken along line II-II of FIG. 5.
Figure 7:
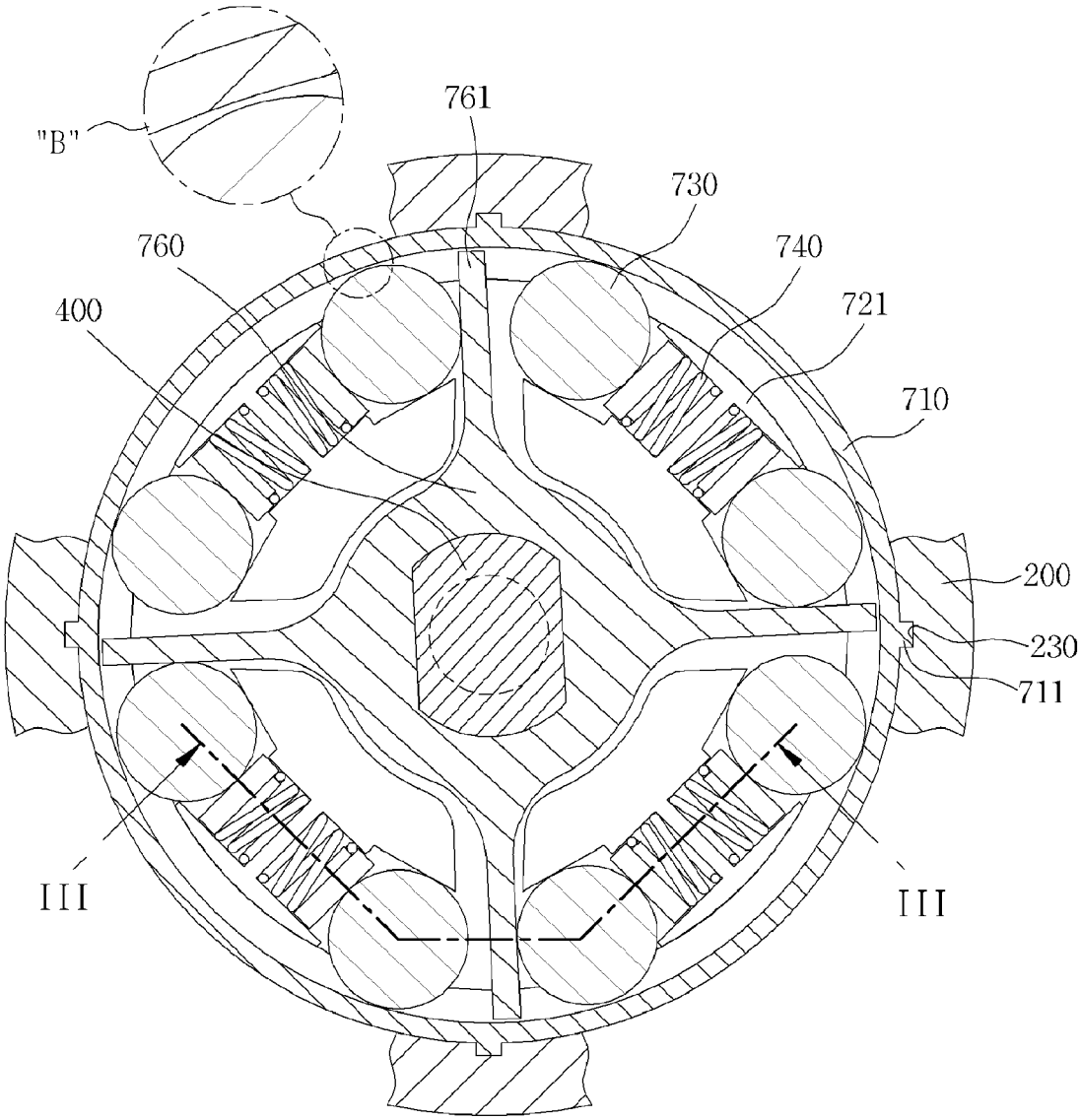
FIG. 7 illustrates a state that the movable piece located between neighboring mounts is moved to the right.
Figure 8:
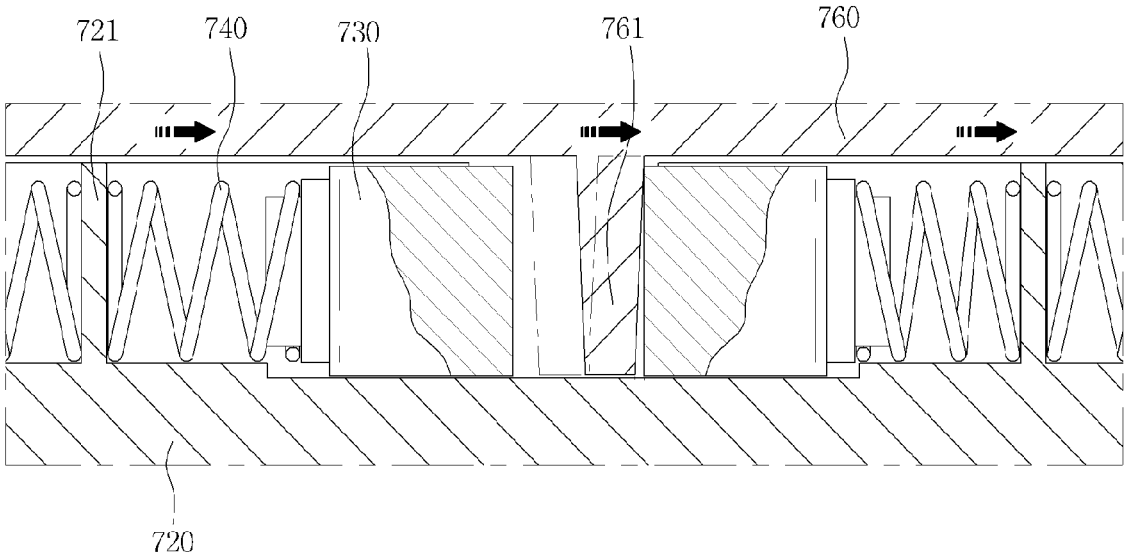
FIG. 8 is a cross-sectional view taken along line III-III of FIG. 7.
Figure 9:
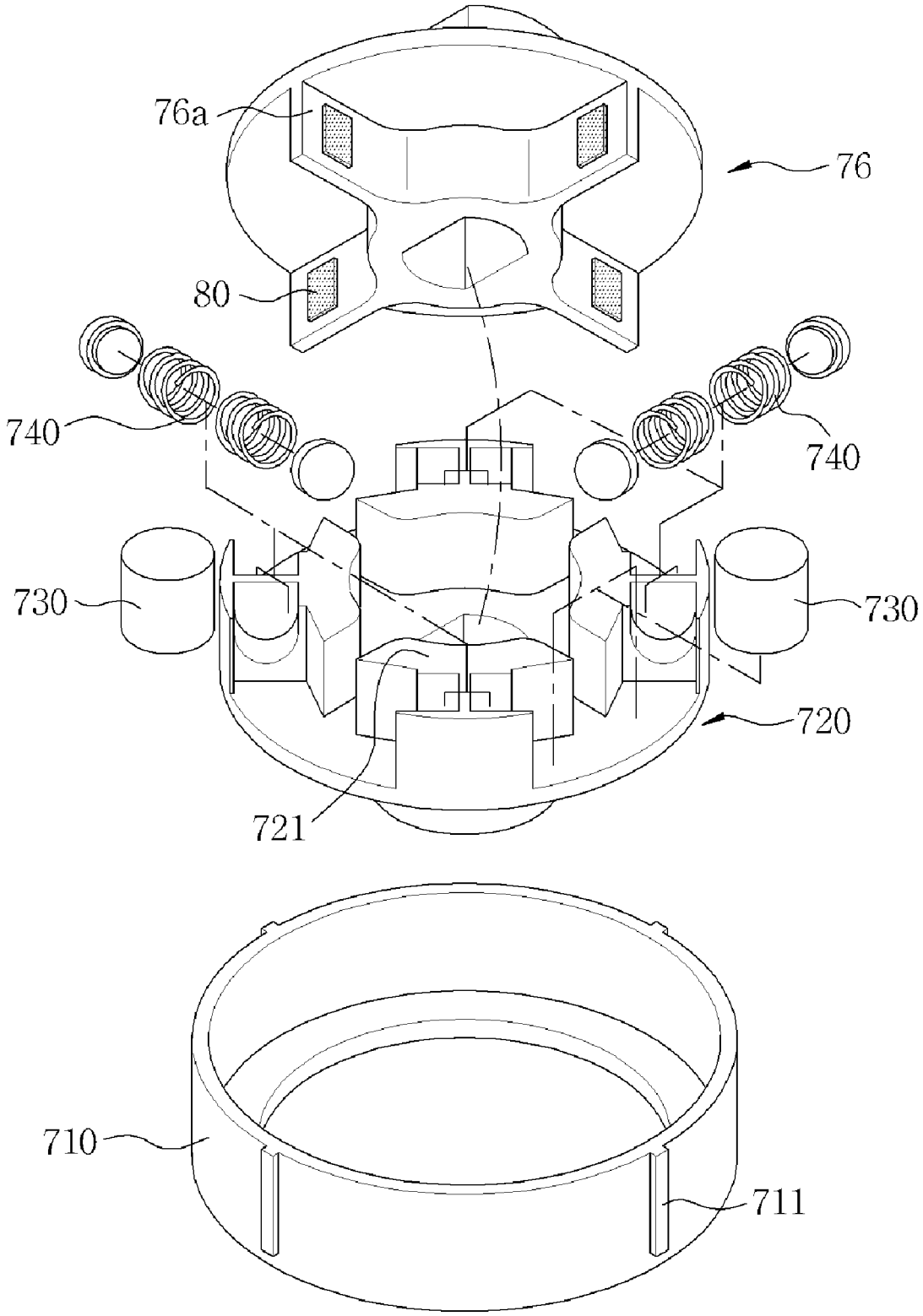
FIG. 9 is an exploded perspective view of a fixing unit of a steering apparatus according to an embodiment of the present invention.

The present invention will now be described more fully with reference to the accompanying drawings, in which exemplary embodiments of the invention are shown. Like reference numerals in the drawings denote like elements, and thus their description will be omitted.

A steering apparatus according to an embodiment of the present invention will now be explained with reference to FIGS. 9 through 15.

Referring to FIGS. 9 through 15, the steering apparatus according to an embodiment of the present invention includes a cylindrical fixed frame 710, a rotary plate 720 rotatably set inside the fixed frame 710, a plurality of mounts 721 arranged on the rotary plate 720 such that cylindrical rolling elements 730 and elastic elements 740 are mounted thereon, a rotary cover 96 having a movable part with movable pieces 76*a* capable of pressing the rolling elements 730 when a steering shaft 400 is operated and covering the top of the rotary plate 720 to prevent the rolling elements 730 and the elastic elements 740 from being separated from the mounts 721, the elastic elements 740 mounted on the mounts 721 to apply elasticity to the rolling elements 730 to press the rolling elements 730 against the inner face of the fixed frame 710, and the steering shaft 400 penetrating the fixed frame 710, the rotary plate 720 and the rotary cover 76. The movable pieces 76*a* press the rolling elements 730 according to the operating power of the steering shaft 400 such that the rolling elements 730 are separated from the inner face of the fixed frame 710 to rotate the rotary plate 720. When the operating power of the steering shaft 400 is cancelled, the rolling elements 730 are pressed against the inner side of the fixed frame 710 according to the restoring force of the elastic elements 740 to fix the steering shaft 400. The steering apparatus of the present invention includes elastic pads 80 capable of eliminating the gap between the movable pieces 76*a* and the rolling elements 730. The elastic pads 80 are attached to portions of the movable pieces 76*a*, which come into contact with the rolling elements 730.

The elastic pads 80 may be formed of plastics. If the movable pieces 76*a* are tapered, the elastic pads 80 may be tapered such that a portion of each elastic pad 80, which corresponds to the thinner portion of each movable piece 76*a*, is thicker than a portion of the elastic pad 80, which corresponds to the thicker portion of each movable piece 76*a*. The thickness of the elastic pads 80 may be less than 1.5 mm.

The rolling elements 830 have a cylindrical shape.

The operation of the steering apparatus according to the present invention will now be explained.

When the steering shaft 400 is not operated, each movable piece 76*a* does not press the rolling element 730 corresponding thereto and is located in the middle of the rolling element 730 and the neighboring rolling element 730. Here, there is no gap between the movable piece 76*a* and the rolling element 730 according to the elastic pads 80 attached to both sides of the movable piece 76*a*.

At this time, the rotary plate 720 is not rotatable because the rolling elements 730 placed at both sides of each mount 721 are pressed against the inner face of the fixed frame 710 according to the restoring force of the elastic elements 740 and functions as a wedge.

Figure 10:
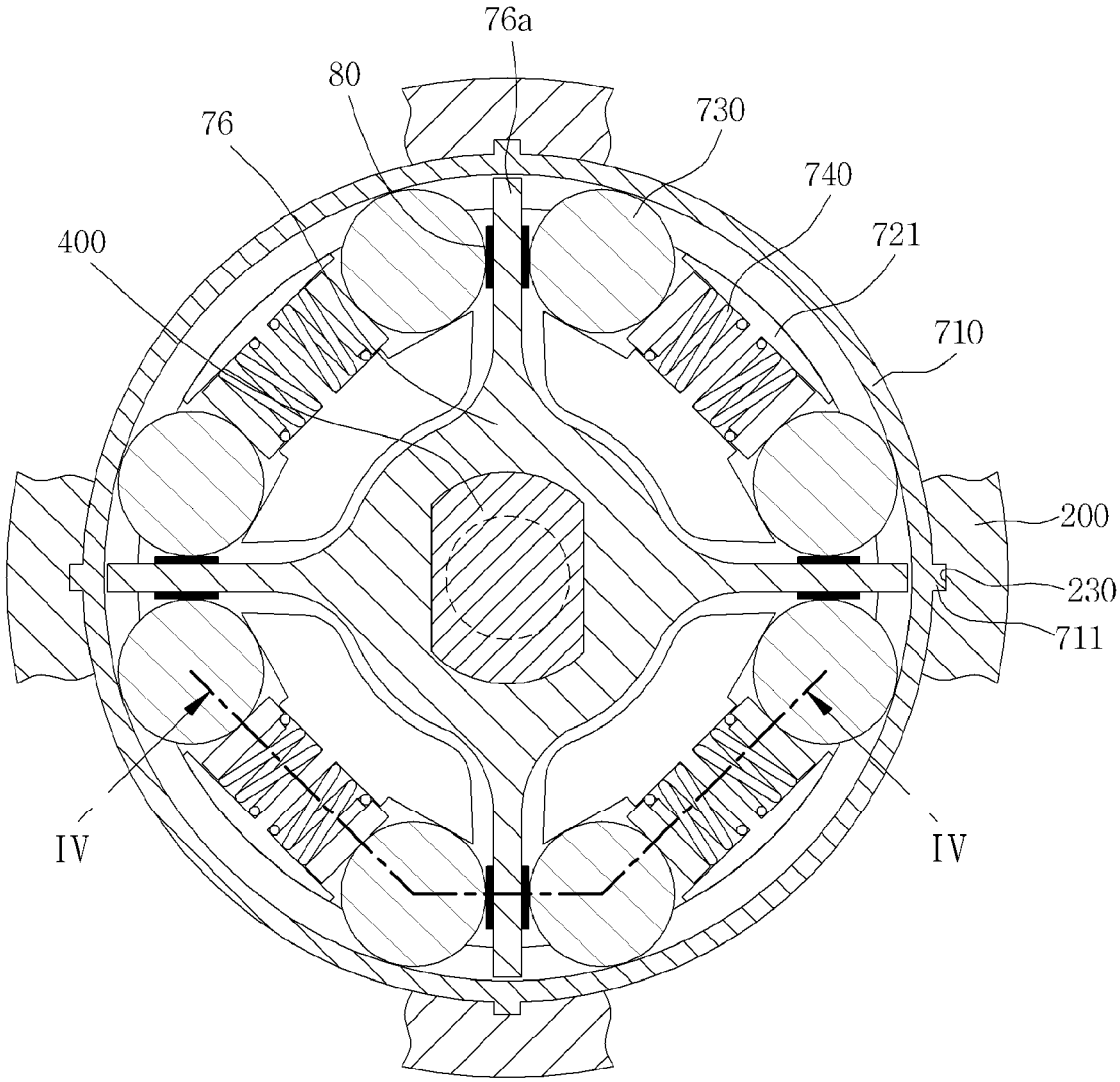
FIG. 10 illustrates a state that a movable piece located between neighboring mounts is not moved.
Figure 11:
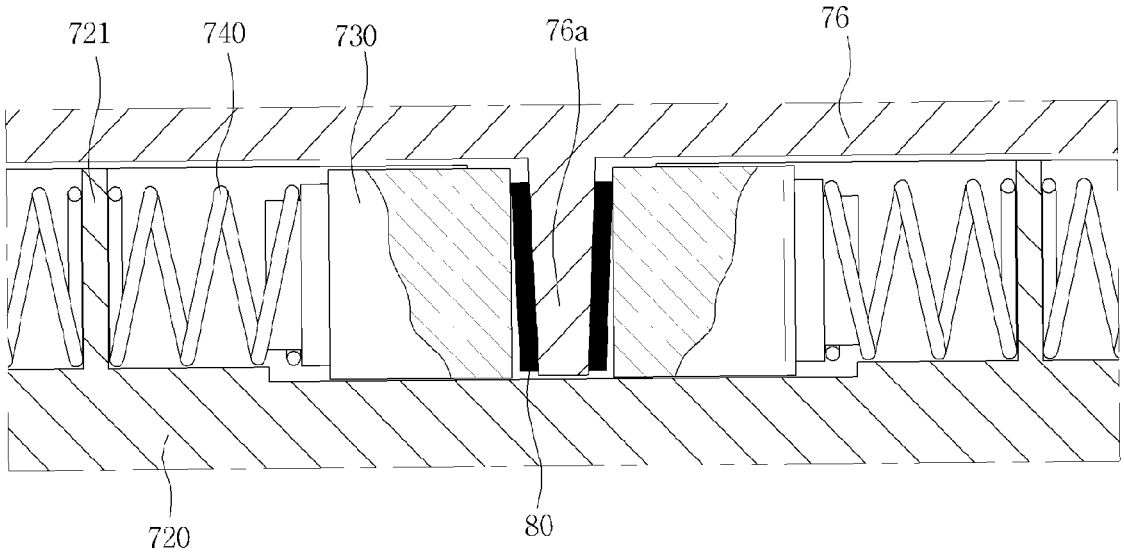
FIG. 11 is a cross-sectional view taken along line IV-IV of FIG. 10.
Figure 12:
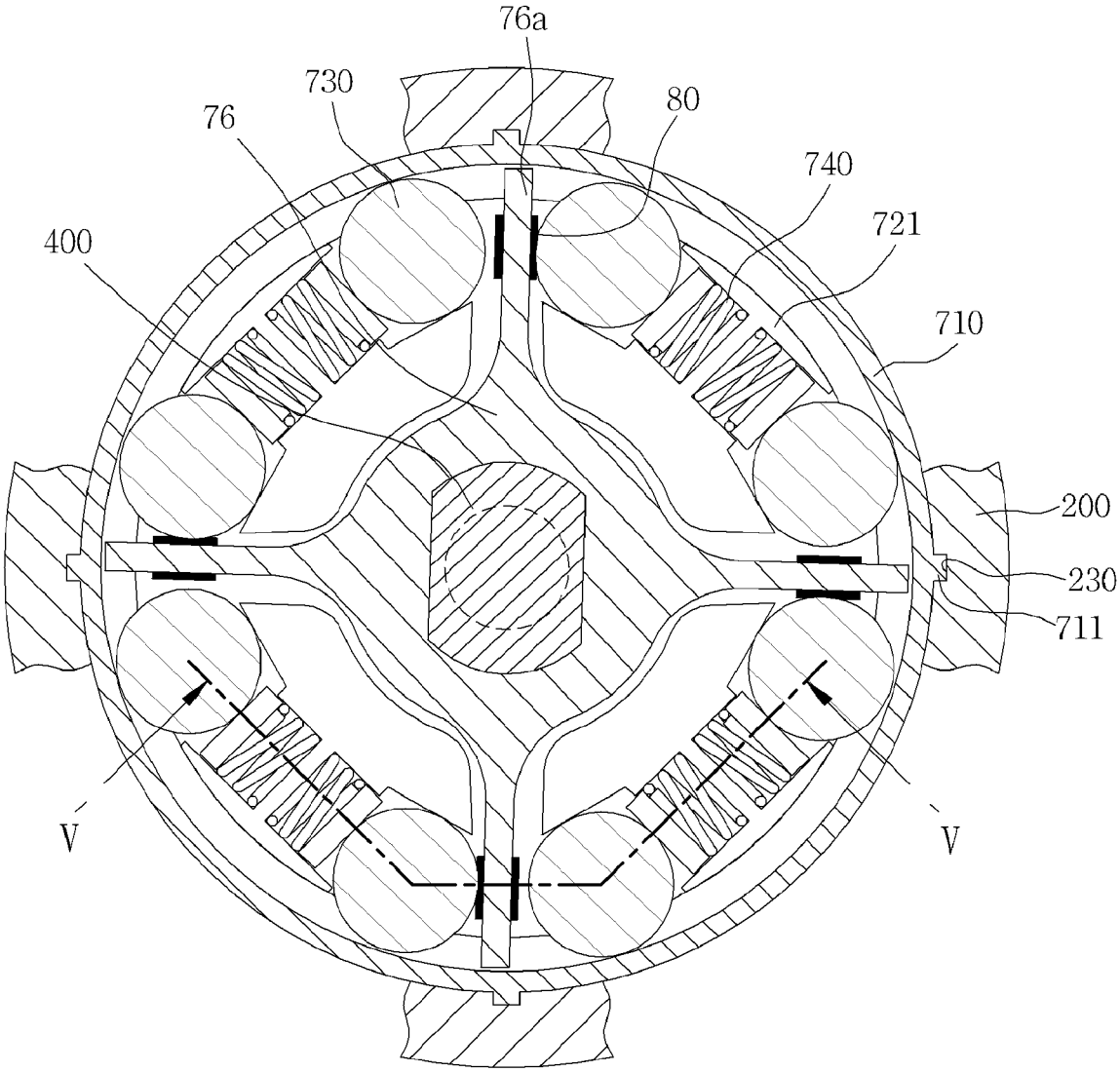
FIG. 12 illustrates a state that the movable piece located between neighboring mounts is moved to the left.
Figure 13:
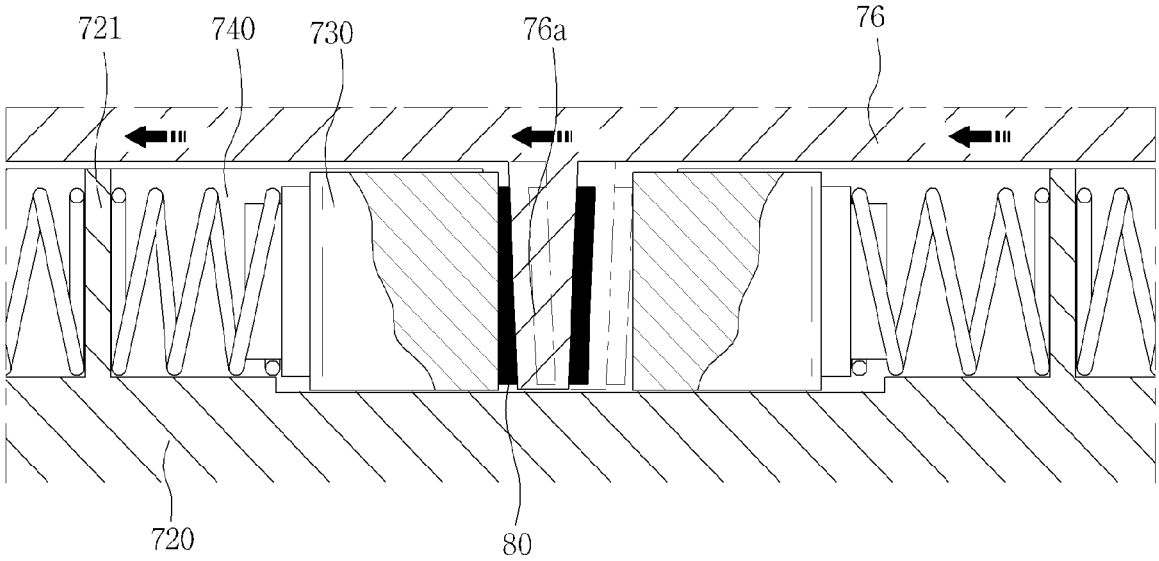
FIG. 13 is a cross-sectional view taken along line V-V of FIG. 12.
Figure 14:
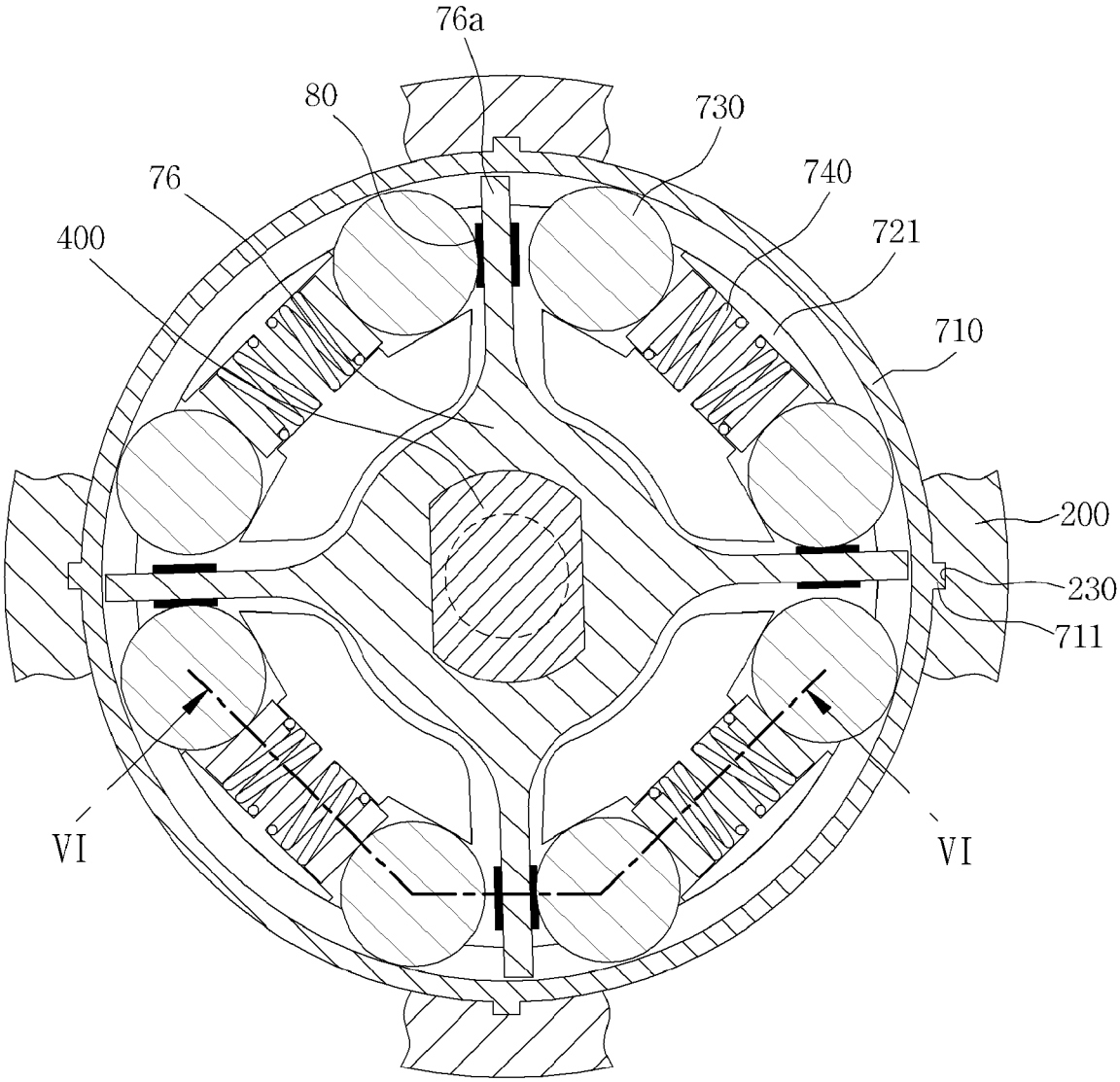
FIG. 14 illustrates a state that the movable piece located between neighboring mounts is moved to the right.
Figure 15:
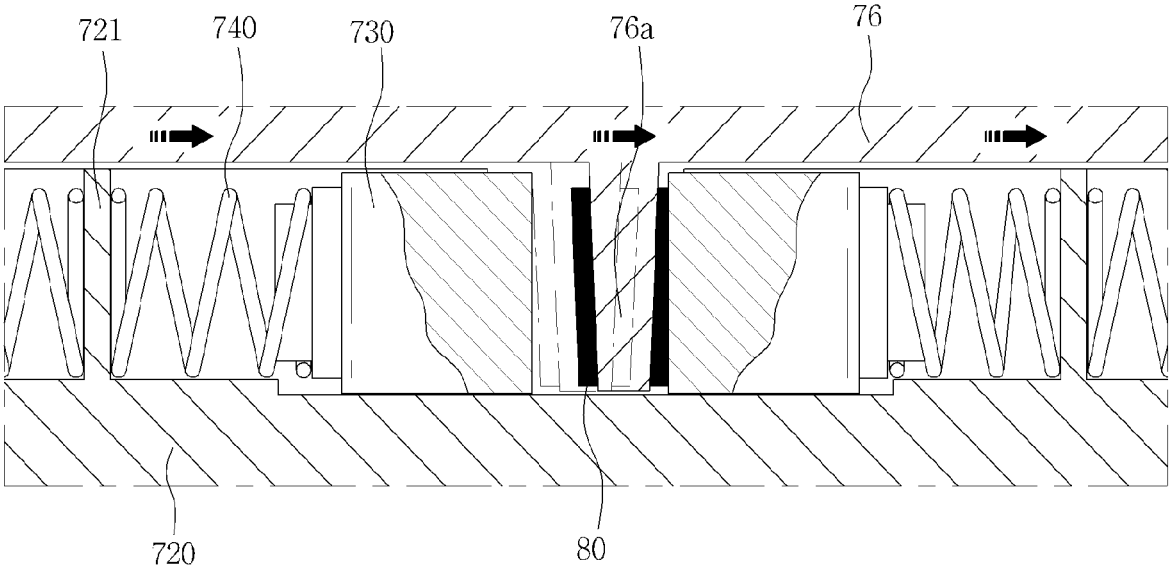
FIG. 15 is a cross-sectional view taken along line VI-VI of FIG. 14.

Accordingly, even when the cable C connected to the engine E vibrates according to vibration of the engine E, the rotary cover 76 is not moved because the gap between the rotary cover 76 and the rotary plate 720, that is, the gap between the movable pieces 76*a* and the rolling elements 730 is eliminated according to the elastic pads 80, and thus the steering handle H is not rotated (refer to FIGS. 10 and 11).

When the steering handle H of the ship is rotated to the left or right (clockwise or counter clockwise), the rotary cover 76 combined with the steering shaft 400 is moved and thus the elastic pads 80 attached to the movable pieces 76*a* are slightly compressed to press the rolling elements 730. Then, the rolling elements 730 are separated from the inner face of the fixed frame 710 according to compression of the elastic elements 740 (refer to FIG. 12).

The pressing force of the movable pieces 76*a* is evenly applied to the cylindrical rolling elements 730 in the longitudinal direction of the rolling elements 730 because the elastic pads 80 attached to the movable pieces 76*a* have elasticity.

The rolling elements 730 placed opposite to the rotating direction of the movable pieces 76*a* are movable although the restoring force of the elastic elements 740 is applied thereto (refer to FIGS. 12, 13, 14 and 15).

Specifically, when the steering handle H is rotated to the left or right (clockwise or counter clockwise), the rotary cover 76 is moved and the movable pieces 76*a* of the rotary cover 76 press the rolling elements 730 located in the rotating direction of the movable pieces 76*a*. Then, the rolling elements 730 compress the elastic elements 740, and thus the rolling elements 730 are separated from the inner face of the fixed frame 710 and the rotary plate 720 becomes rotatable.

The rotary power of the rotary plate 720 is transmitted to the cable C through the reduction gear unit 500 and the rotating plate 110 to change the direction of the engine E connected to the cable C, and thus the direction of the ship is changed.

The operating power applied to the steering shaft 400 though the steering handle H is eliminated after the direction of the chip is changed, each rolling element 730 mounted on each mount 721 is pressed against the inner face of the fixed frame 710 to function as a wedge according to the restoring force of the corresponding elastic element 740 to prevent the rotary plate 720 from rotating, and thus the steering shaft 400 is fixed to maintain the direction of the ship, as illustrated in FIGS. 10 and 11.

Figure 16:
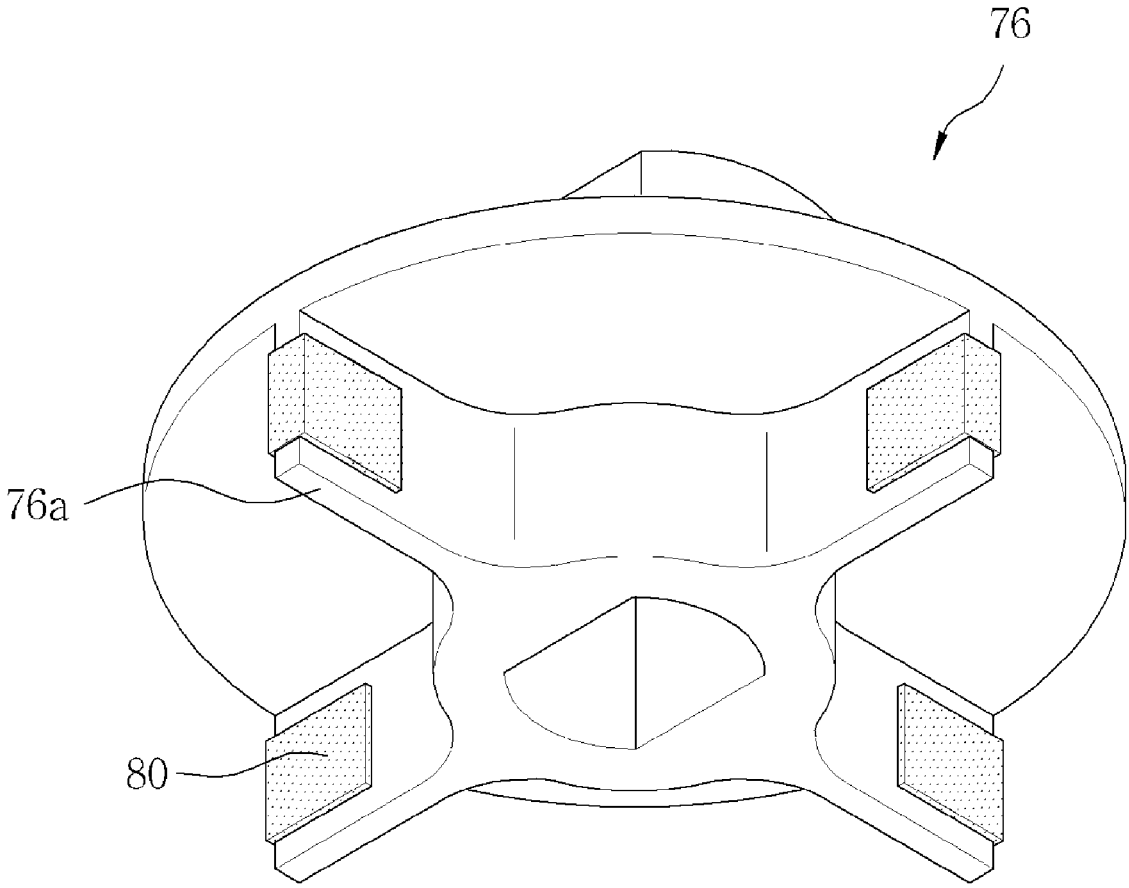
FIG. 16 is a perspective view illustrating a state that an elastic pad is attached to the end of a movable piece of a rotary cover according to another embodiment of the present invention.
Figure 17:
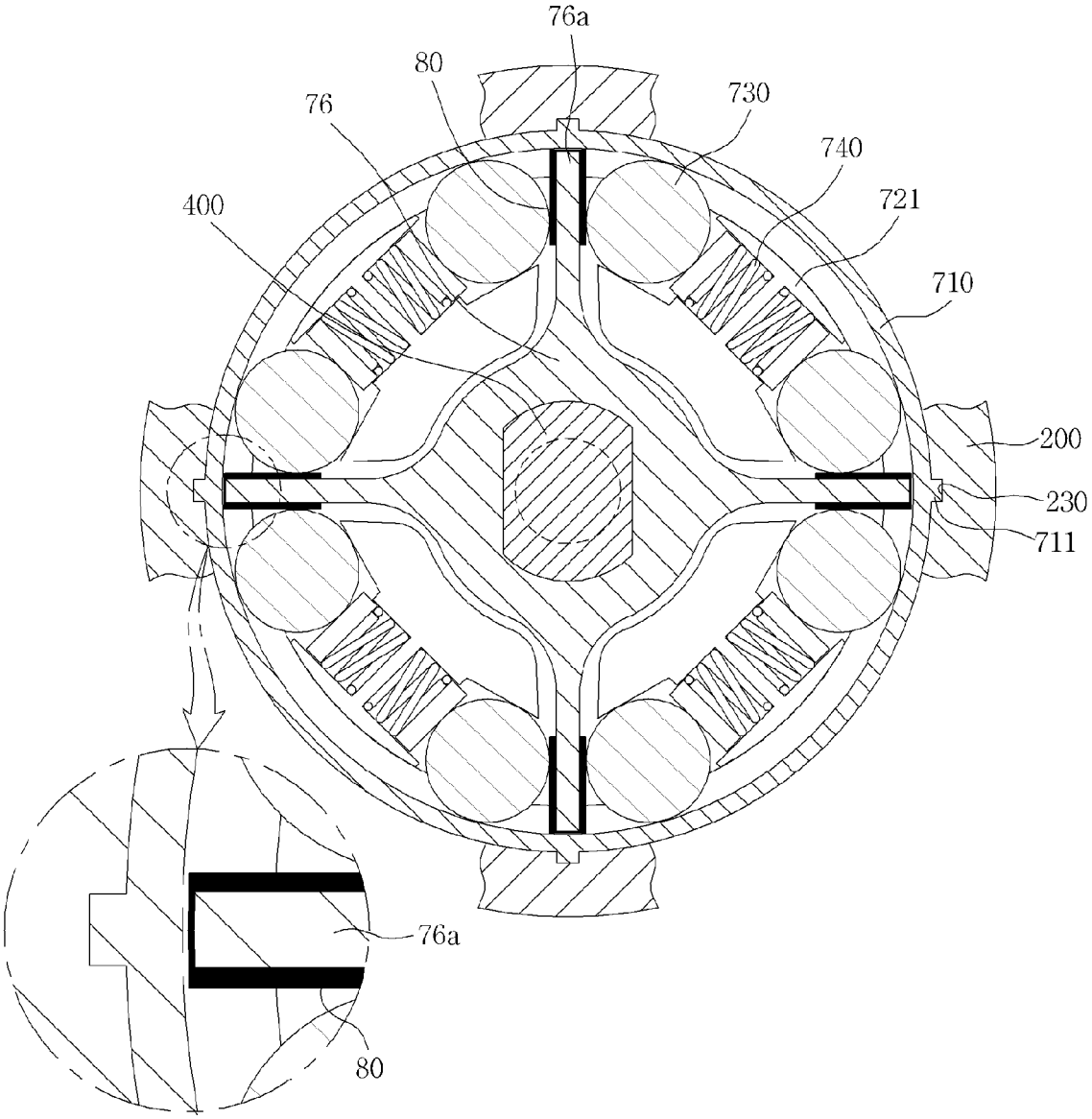
FIG. 17 is a cross-sectional view illustrating a state that the elastic pad is attached to the end of the movable piece located between neighboring mounts.

Another embodiment of the present invention will now be explained with reference to FIGS. 16 and 17.

The steering apparatus may include elastic pads 80 having a cross-sectional form of "ㄷ"such that the elastic pads 80 respectively surround the ends of the movable pieces 76*a*.

That is, the elastic pads 80 having the cross-sectional form of "ㄷ"are fixed to the movable pieces 76*a* in such a manner that the ends of the movable pieces 76*a* are fitted into the elastic pads 80. Although rectangular elastic pads 80 may be respectively attached to both sides of the end of each movable piece 76*a*, as described above, the elastic pad 80 having the cross-sectional shape of "ㄷ"is more effective because the single elastic pad 80 can cover both sides of the end of each movable piece 76*a*.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A steering apparatus comprising:

a cylindrical fixed frame;

a rotary plate rotatably set inside the fixed frame;

a plurality of mounts arranged on the rotary plate and having rolling elements and elastic elements mounted thereon;

the elastic elements mounted on the mounts and applying elasticity to the rolling elements to press the rolling elements against the inner face of the fixed frame;

a rotary cover including a movable part having movable pieces capable of pressing the rolling elements when a steering shaft is operated and covering the top of the rotary plate to prevent the rolling elements and the elastic elements from being separated from the mounts;

the steering shaft penetrating the fixed frame, the rotary plate and the rotary cover; and elastic pads respectively attached to portions of the movable pieces, which come into contact with the rolling elements, to eliminate a gap between each movable piece and each rolling element.

2. The steering apparatus of claim 1, wherein the movable pieces press the rolling elements according to the operating power of the steering shaft such that the rolling elements are separated from the inner face of the fixed frame to rotate the rotary plate and, when the operating power of the steering shaft is eliminated, the rolling elements are pressed against the inner side of the fixed frame according to the restoring force of the elastic elements and thus the steering shaft is not rotated.

3. The steering apparatus of claim 1, wherein the rolling elements are located on both sides of each movable piece and come into contact with the elastic pads attached to both sides of the movable piece when the operating power of the steering shaft is not applied or is eliminated.

4. The steering apparatus of claim 3, wherein the rolling elements located on both sides of each mount are pressed against the inner face of the fixed frame according to the restoring force of the elastic elements to fix the rotary plate.

5. The steering apparatus of claim 1, wherein the elastic pads are made of rubber.

6. The steering apparatus of claim 1, wherein, when the movable pieces are tapered, the portion of the elastic pad, which corresponds to the thinner portion of each movable piece, is thicker than the portion of the elastic pad, which corresponds to the thicker portion of each movable piece.

7. The steering apparatus of claim 1, wherein the thickness of the elastic pad is less than 1.5 mm.

8. The steering apparatus of claim 1, wherein the elastic pads have a cross-sectional form of "ㄴ"such that the elastic pads respectively surround the ends of the movable pieces.

* * * * *